US007543816B2

(12) United States Patent
Crerar

(10) Patent No.: US 7,543,816 B2
(45) Date of Patent: Jun. 9, 2009

(54) DIVERTING STACKER WHEEL

(75) Inventor: Roy A. Crerar, Edinburgh (GB)

(73) Assignee: NCR Corporation, Dayton, OH (US)

( * ) Notice: Subject to any disclaimer, the term of this patent is extended or adjusted under 35 U.S.C. 154(b) by 259 days.

(21) Appl. No.: 11/608,483

(22) Filed: Dec. 8, 2006

(65) Prior Publication Data

US 2008/0136096 A1 Jun. 12, 2008

(51) Int. Cl.
*B65H 29/20* (2006.01)

(52) U.S. Cl. ..... 271/300; 271/315; 271/307

(58) Field of Classification Search ..... 271/300, 271/306, 307, 308, 314, 315, 187
See application file for complete search history.

(56) References Cited

U.S. PATENT DOCUMENTS 5,040,783 A * 8/1991 Ruehl ..... 271/300
5,180,160 A * 1/1993 Belanger et al. ..... 271/315

* cited by examiner

*Primary Examiner*—Kaitlin S Joerger

(57) ABSTRACT

A stacker wheel is described which has two different types of slots defined by the tines. The first type of slot has an end which is positioned closer to the centre of the stacker wheel than the second type of slot such that the first type of slot can hold media closer to the centre of the stacker wheel than the second type of slot.

6 Claims, 6 Drawing Sheets

FIG. 7
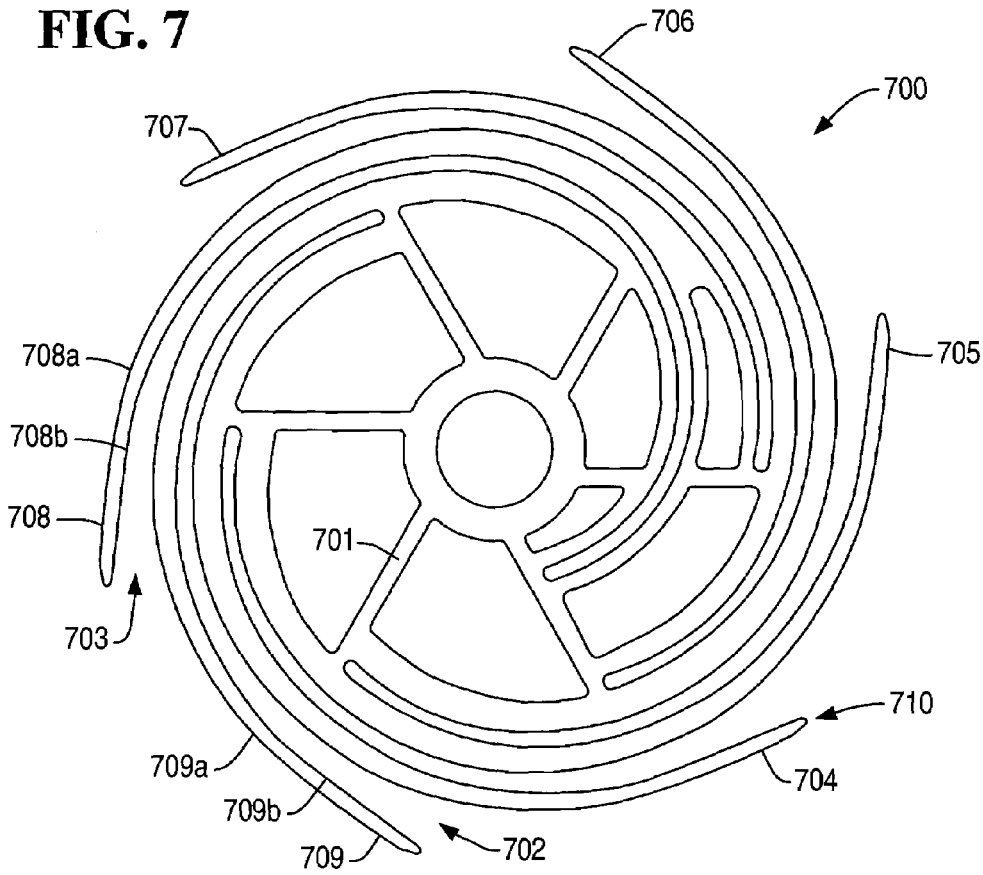
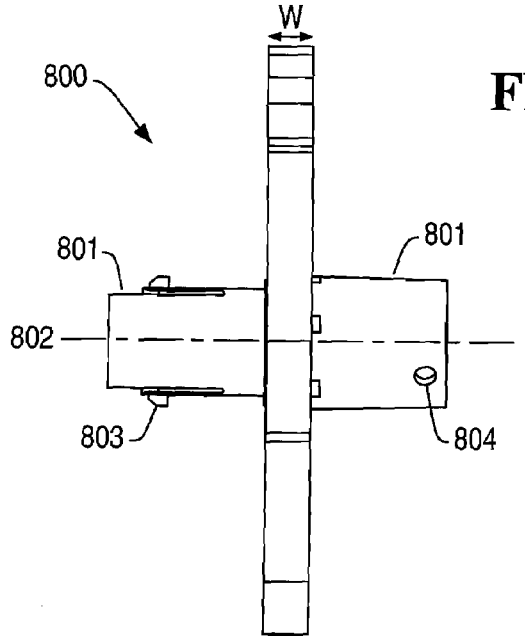
FIG. 8

DIVERTING STACKER WHEEL

TECHNICAL FIELD

The present invention relates to a diverting stacker wheel. It is particularly related to, but in no way limited to, stacker wheels for handling media in an automated teller machine (ATM).

BACKGROUND

Stacker (or stacking) wheels are commonly used in automated teller machines (ATMs) to stack multiple currency notes prior to dispensing the stack of notes to a user of the ATM. The operation of a stacker wheel can be described with reference to FIG. 1 which shows a schematic side elevation view of a cash dispenser unit 73 of an ATM. The cash dispenser unit 73 includes a stacker wheel assembly 75. The stacker wheel assembly 75 comprises a plurality of stacker wheels 76 spaced apart in a parallel relationship along a shaft 77, each stacker wheel 76 having a plurality of curved tines 78.

FIGS. 2A and 2B show more detailed diagrams of a stacker wheel 201 comprising a plurality of curved tines 202 on a central hub 203. At the centre of the hub 203 is an aperture 204 that enables the stacker wheel 201 to be mounted on a metal shaft (not shown). Currency notes can be held by the stacker wheel in compartments 205 formed between adjacent tines. The width of the stacker wheel is very narrow (2.54 mm) compared to the diameter of the wheel (101.60 mm).

The cash dispenser unit 73 (as shown in FIG. 1) holds a number of currency cassettes 89 each holding a stack of currency notes 68. When one or more notes are to be dispensed from a particular cassette, the pick mechanism 74 associated with the cassette draws a note from the cassette such that its leading edge is gripped between drive rollers 90. The note is then fed along the feed path 72 by further drive rollers 92, through a retard mechanism 10 to the stacker wheel assembly 75. In operation, the stacker wheel assembly 75 rotates continuously in a counter-clockwise direction (for the arrangement shown in FIG. 1) and the note is fed into a compartment 81 formed between adjacent tines 78. If more than one note is to be dispensed, each note is fed into a successive compartment 81 as the stacker wheel assembly 75 rotates. Having completed half a rotation, the note is removed from the stacker wheel assembly 75 by fingers 94 of a stripper plate assembly 96 pivotally mounted on a shaft 98. Once removed from the stacker wheel, the note is placed on a belt 100 resting against the stripper plate assembly 96 and any subsequent notes which are to be dispensed simultaneously with the first note are placed on top of the first note to form a bundle 68'. When the required amount of notes (which may be just one note) have been assembled into the bundle 68', a pair of belts 102 (only one of which is shown in FIG. 1) is rotated on a shaft 104 such that the bundle 68' is trapped between the belts 100, 102. The bundle is then fed between belts 100, 102, 106, 108 through a note exit slot 110 in the housing 112 of the cash dispenser unit 73 to a position where the bundle 68' can be collected by the user of the ATM. If a multiple feeding is detected in the course of stacking the bundle of notes 68' or one or more of the notes are rejected for any reason, the bundle is not fed to the note exit slot 110. Instead the stripper plate assembly 96 is pivoted into a position as shown by the dashed outline 96' and the belts 100, 102 are operated in the reverse direction to deposit the bundle 68' into a reject note container 114 via an opening 116.

By rejecting bundles of notes at this late stage in the dispensing process, many notes may be deposited in the reject note container (e.g. where 50 notes are being dispensed and the 50th note is rejected, 49 "good" notes are deposited in the reject note container. This increases the transaction time for a user, results in the reject note container becoming full quickly and decreases the number of wasted "good" notes as these cannot now be dispensed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A stacker wheel is described which has two different types of slots defined by the tines. The first type of slot has an end which is positioned closer to the centre of the stacker wheel than the second type of slot such that the first type of slot can hold media closer to the centre of the stacker wheel than the second type of slot.

A first aspect provides a stacker wheel having an axis of rotation central to said stacker wheel, said stacker wheel comprising: a plurality of tines attached to a central hub, said plurality of curved tines defining a plurality of slots therebetween, and each said slot having an end proximal to said central hub; and wherein said plurality of slots comprises at least one of a first type of slot and at least one of a second type of slot, said first type of slot having said end positioned closer to said axis of rotation than said end of said second type of slot.

Each slot may comprise a curved portion proximal to said end and a straight portion distal to said end. The straight portion of one of said first type of slot may, in some examples, be parallel to said straight portion of one of said second type of slot.

The stacker wheel may comprise at least four tines and said plurality of slots may comprise at least one of said first type of slot and at least two of said second type of slot.

The plurality of slots may comprise an equal number of said first type of slot and said second type of slot. In some examples, said slots of said first type and said second type may be interleaved.

The first type of slot may be longer than said second type of slot.

The first type of slot may be wider than said second type of slot.

A second aspect comprises a media dispenser including a stacker wheel having an axis of rotation central to said stacker wheel, said stacker wheel comprising: a plurality of tines attached to a central hub, said plurality of curved tines defining a plurality of slots therebetween, and each said slot having an end proximal to said central hub; and wherein said plurality of slots comprises at least one of a first type of slot and at least one of a second type of slot, said first type of slot having said end positioned closer to said axis of rotation than said end of said second type of slot.

The media dispenser may further comprise: a first set of fingers arranged to remove media from said first type of slot; and a second set of fingers arranged to remove media from said second type of slot.

The first set of fingers may be further arranged to dispatch media removed from said first type of slot to a purge bin; and the second set of fingers may be further arranged to dispatch media removed said second type of slot to a dispenser slot.

A third aspect comprises an automated teller machine including a stacker wheel having an axis of rotation central to said stacker wheel, said stacker wheel comprising: a plurality of tines attached to a central hub, said plurality of curved tines defining a plurality of slots therebetween, and each said slot having an end proximal to said central hub; and wherein said plurality of slots comprises at least one of a first type of slot and at least one of a second type of slot, said first type of slot having said end positioned closer to said axis of rotation than said end of said second type of slot.

The automated teller machine may further comprise: a first set of fingers arranged to remove media from said first type of slot; and a second set of fingers arranged to remove media from said second type of slot.

The first set of fingers may be further arranged to dispatch media removed from said first type of slot to a purge bin; and the second set of fingers may be further arranged to dispatch media removed said second type of slot to a dispenser slot.

Many of the attendant features will be more readily appreciated as the same becomes better understood by reference to the following detailed description considered in connection with the accompanying drawings. The preferred features may be combined as appropriate, as would be apparent to a skilled person, and may be combined with any of the aspects of the invention.

BRIEF DESCRIPTION OF THE DRAWINGS

Embodiments of the invention will be described, by way of example, with reference to the following drawings, in which:

FIG. 7 shows a diagram of a second example of a diverting stacker wheel; and FIG. 8 shows a side view of a diverting stacker wheel.

Figure 1:
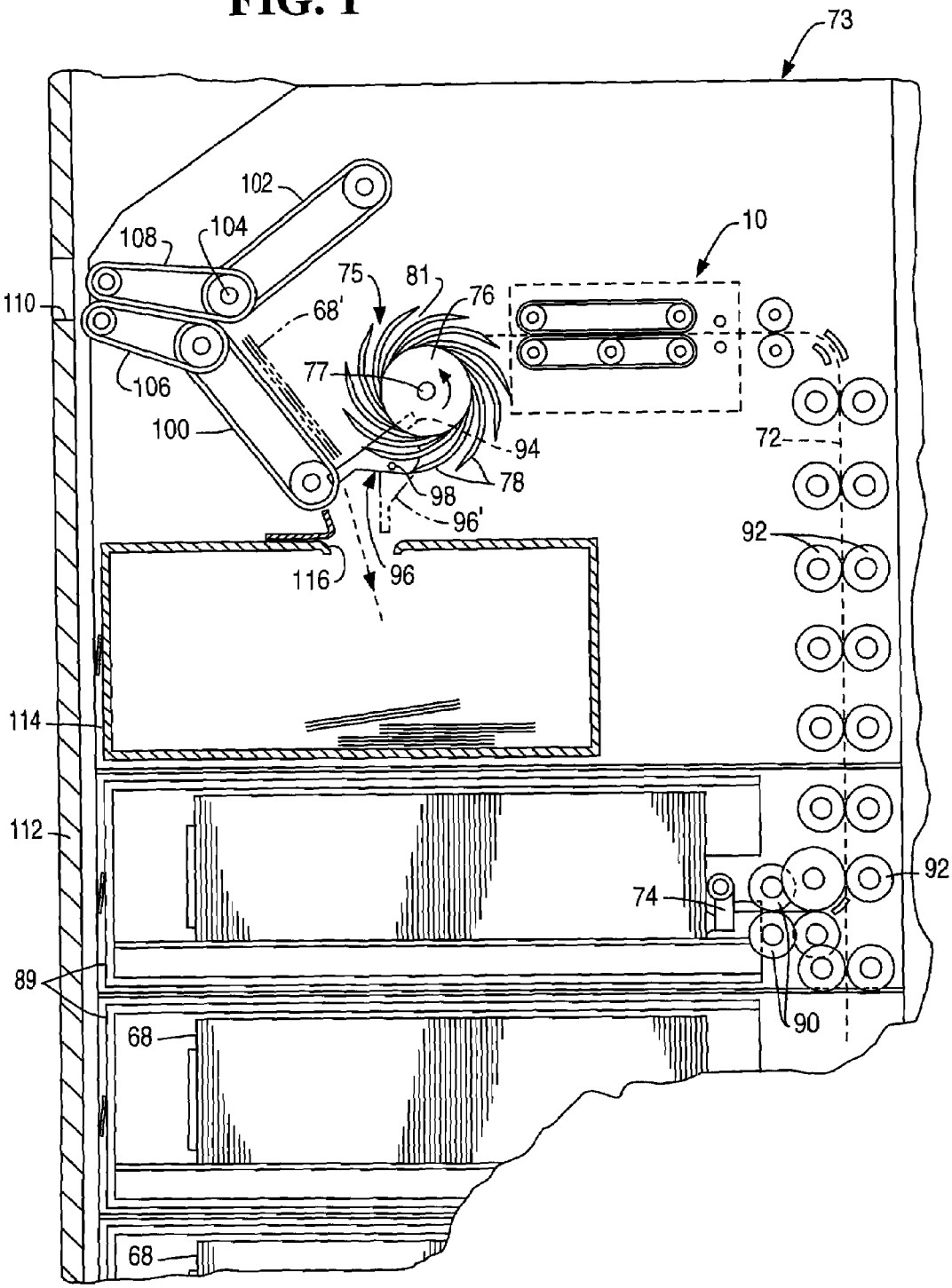
FIG. 1 is a schematic side elevation view of a cash dispenser unit.
Figure 2A:
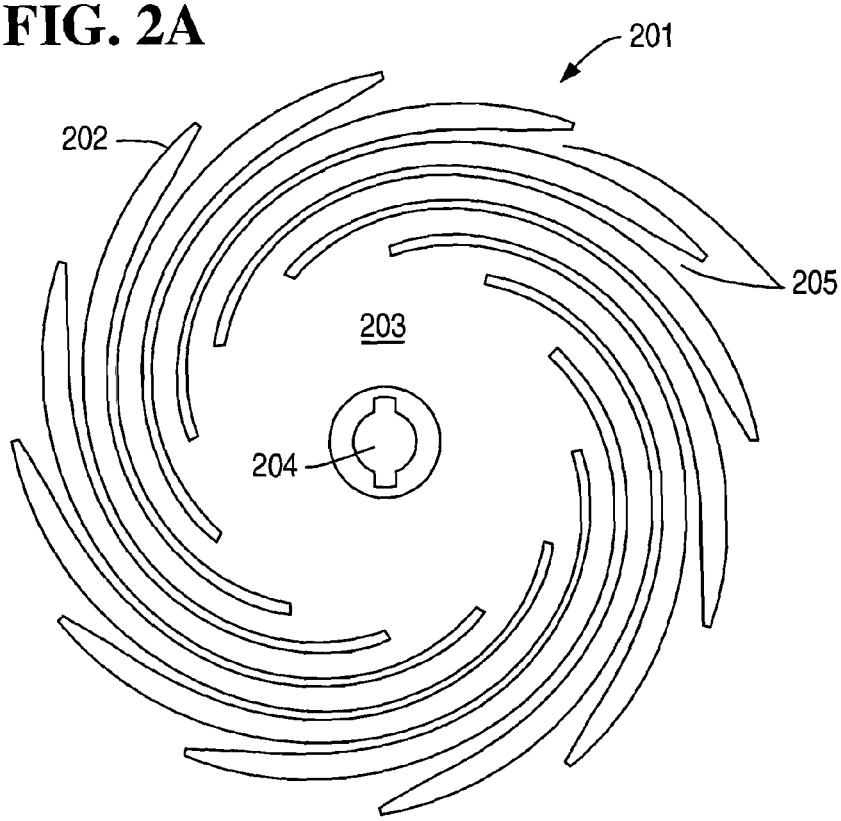
FIGS. 2A and 2B are detailed diagrams of a prior art stacker wheel.
Figure 2B:
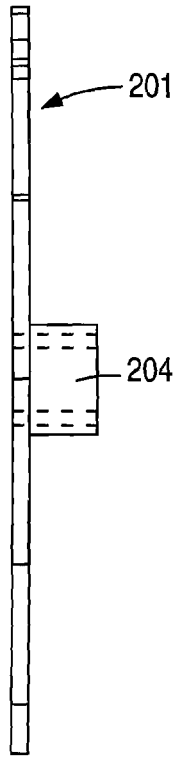

Common reference numerals are used throughout the figures to indicate similar features.

DETAILED DESCRIPTION

Embodiments of the present invention are described below by way of example only. These examples represent the best ways of putting the invention into practice that are currently known to the Applicant although they are not the only ways in which this could be achieved.

Figure 3:
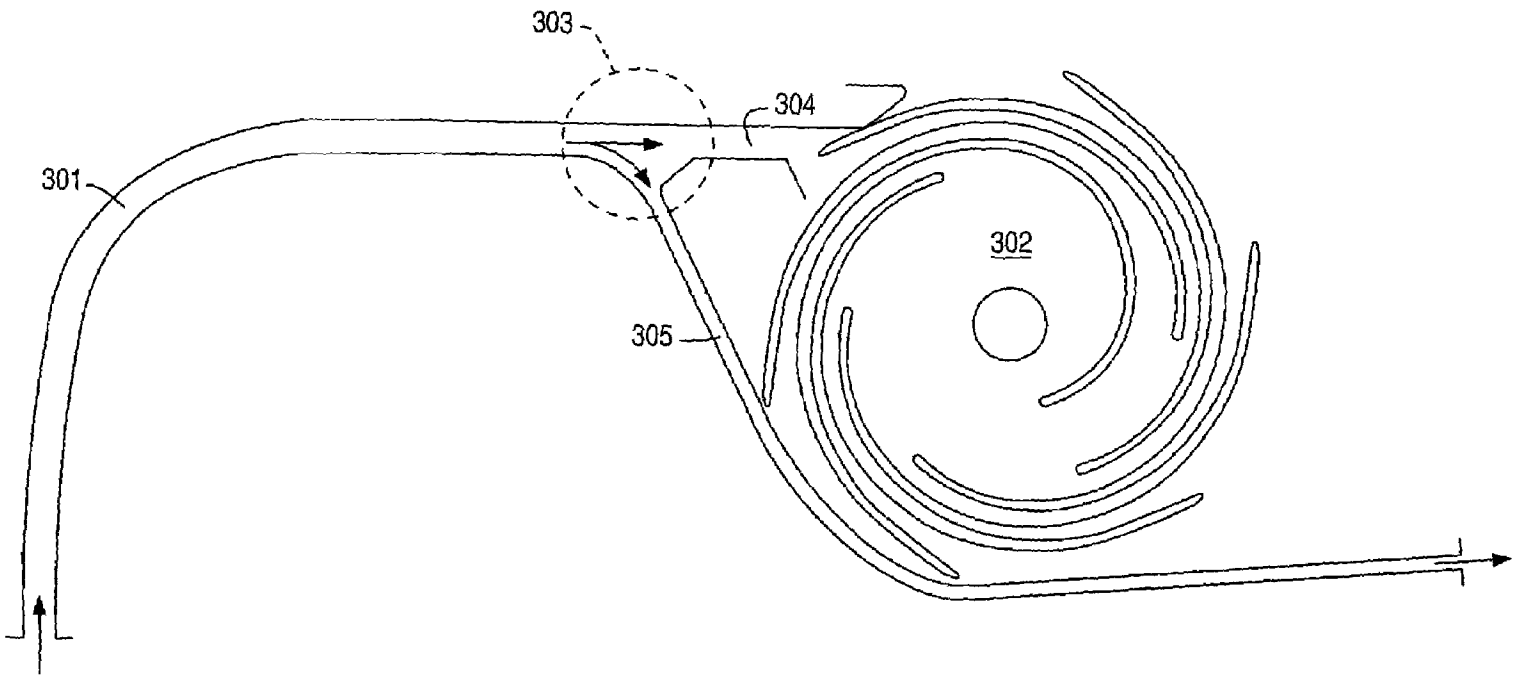
FIG. 3 shows a schematic diagram of a presenter portion of a dispenser.

In order to reduce the occurrence of rejections of a bundle (or stack) of notes, a divert gate may be introduced into the note presenting mechanism which enables rejection of individual notes or groups of notes which have been inadvertently picked together (also known as a 'multiple pick'). The location of the divert gate may be shortly before the stacker wheel, as shown in FIG. 3. FIG. 3 shows a portion of the dispenser referred to as the 'presenter' which includes a portion of the media path 301 as it approaches the stacker wheel 302. Before the media reaches the stacker wheel, in a region 303, the media path splits into two paths: one path 304 towards the stacker wheel 302 and the other path 305 towards a purge (or reject note) bin (not shown in FIG. 3). A divert gate is located within region 303 and directs the notes down the path 304 to the stacker wheel unless a problem is detected (e.g. a multiple pick or folded media) when it diverts the notes down the path 305 to the purge bin. The problems are detected by a media thickness sensor (MTS) which is located within the pick mechanism of the media dispenser.

Whilst the divert gate mechanism reduces the occurrence of rejections of a bundle of notes, in order for it to be able to reject notes identified as a problem by the MTS, there must be sufficient time delay between the media passing through the MTS and the media arriving at the divert gate to enable the problem to be detected and the divert gate to be changed into the divert position. This requirement puts limitations on the location of the MTS which must therefore be placed within pick mechanism (74 in FIG. 1) associated with each cassette within the dispenser. This in turn requires that there must be one MTS for each cassette, which results in a more complex and expensive dispenser. It is not possible for a single MTS to be placed within the presenter as there is insufficient time to detect a problem with the media and to operate the divert gate.

Figure 4:
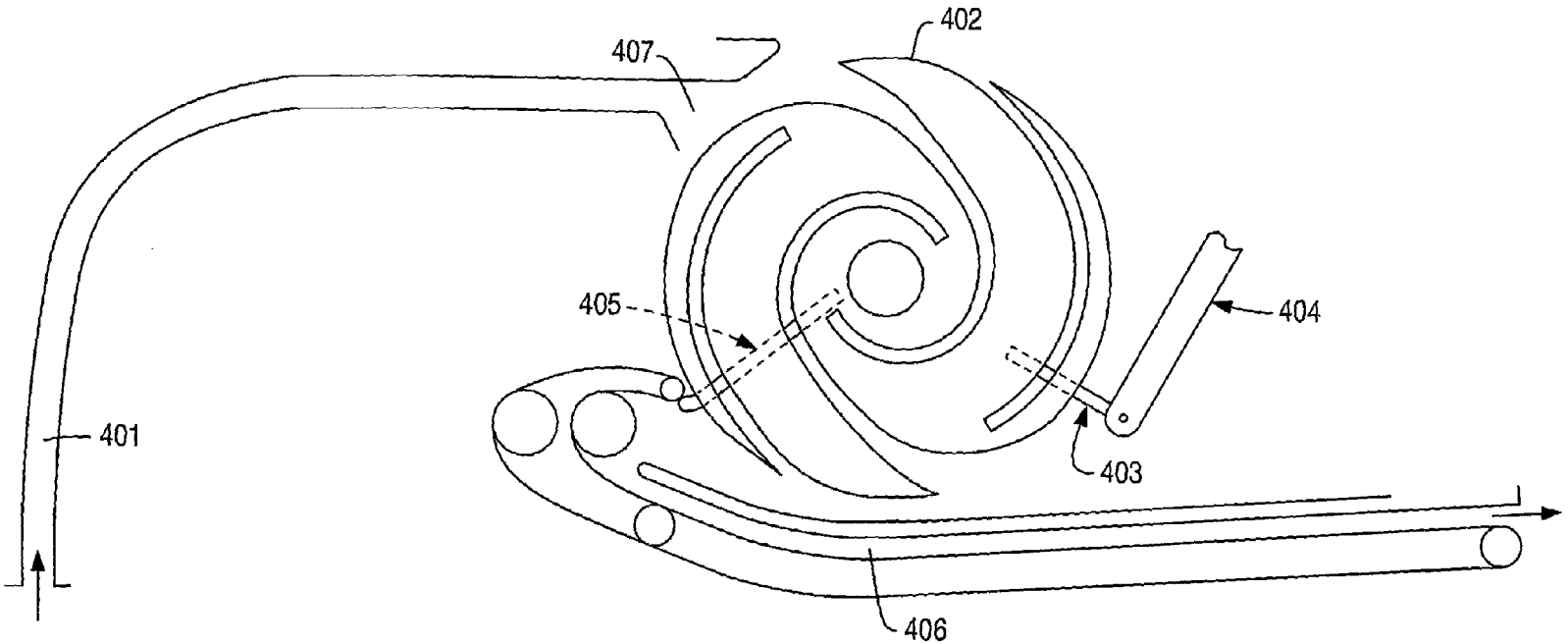
FIG. 4 shows a schematic diagram of a presenter portion of a second dispenser in accordance with the invention.

FIG. 4 shows a schematic diagram of a presenter of a dispenser which includes a mechanism which enables the rejection of individual notes or multiple picks and which is compatible with a single MTS located within the presenter or one or more MTS located elsewhere within the dispenser (e.g. within the pick mechanisms). The presenter comprises a portion of the media path 401 along which media travels to a stacker wheel 402 (also referred to as a diverting stacker wheel). Media is stripped from the stacker wheel either using first stripper fingers 403 which deposit the media in a stack position on a dispense belt 404, or using second stripper fingers 405 which direct the media into a further media path 406. The diverting stacker wheel 402 and the operation of the presenter are described in more detail below.

Figure 5:
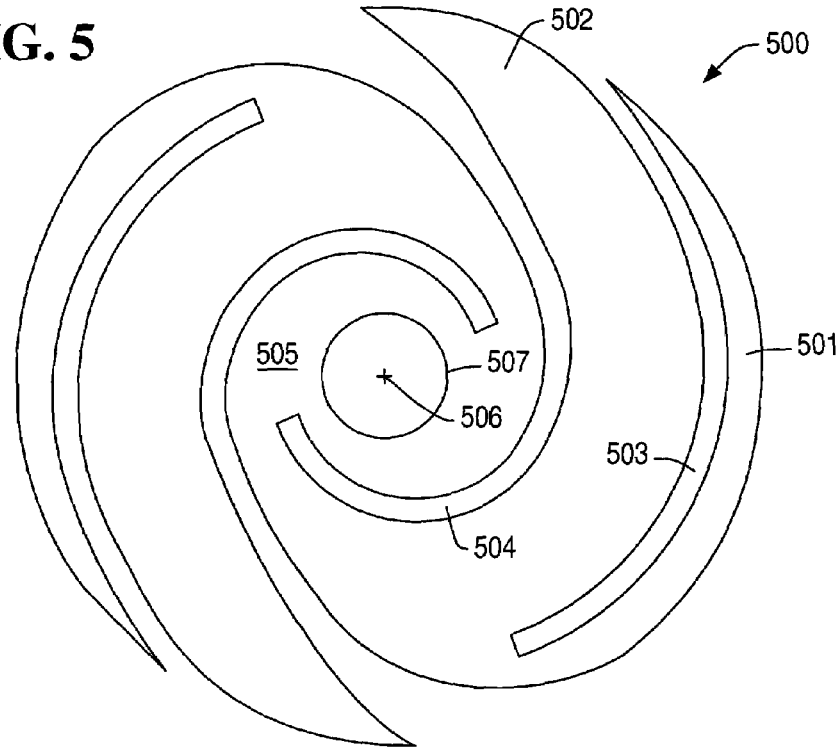
FIG. 5 shows a diagram of an example of a diverting stacker wheel.
Figure 6:
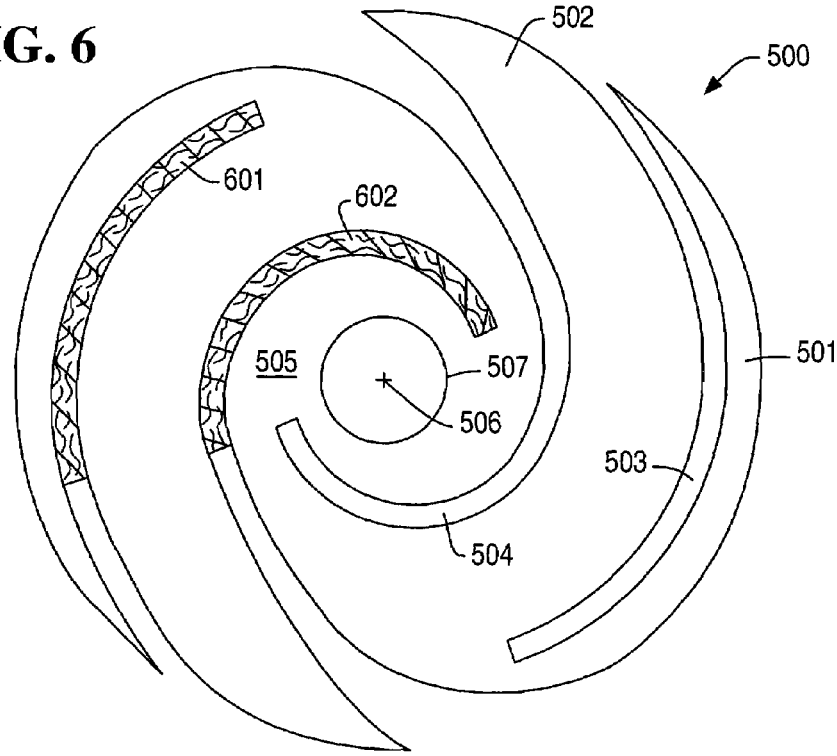
FIG. 6 shows the positions of two pieces of media in the diverting stacker wheel of FIG. 5.

FIG. 5 shows a more detailed diagram of an example of a diverting stacker wheel 500 for use in a media dispenser, for example as part of an automated teller machine (ATM). The wheel comprises a number of curved tines 501, 502 which define a number of slots or compartments 503, 504 between tines. The tines are attached to a hub 505 which may be disk-like as shown in FIG. 5, or may alternatively be web-like (i.e. discrete spokes rather than a solid planar disk, as shown in FIG. 7). In use the stacker wheel 500 rotates about an axis of rotation 506 central to the axle 507. The curved tines define two different types of slots 503, 504 of different sizes: one slot type (slot 504, referred to as a 'reject slot') being longer and holding the media much closer to the centre of the wheel than the other slot type (slot 503, referred to as a 'dispense slot'). FIG. 6 shows the diverting stacker wheel 500 of FIG. 5 with the positions of two pieces of media 601, 602 shown. The position of the media 602 in the reject slot is much closer to the centre (and the axis of rotation 506) of the stacker wheel. The diverting stacker wheel 500 is capable of handling many different types of media including, but not limited to currency notes, tickets (e.g. train tickets), credit/debit cards and mobile phone top-up cards.

As shown in FIG. 5, the diverting stacker wheel may have slots which are the same width over their entire length (i.e. they do not taper). In other examples, all the slots or some of the slots (e.g. only dispense slots or only reject slots) may taper such that their width reduces towards the central hub (e.g. as shown in FIG. 7). The reject and dispense slots may be of equal width or they may be of different width, where the width of a slot is defined within the plane of FIG. 5 and along a radius of the wheel. For example, the width of the reject slot (slot 504) may be larger (e.g. 50% larger) than the width of the dispense slot (slot 503) such that it can accommodate multiple picks (as shown in FIG. 5). In an example, a reject slot may be 3 mm wide whilst a dispense slot may be only 2 mm wide. In addition to, or instead of, having a wider reject slot, the opening to the reject slot may be larger than the opening to the dispense slot, again such that the reject slot can more easily accommodate multiple picks or folded media.

In the example shown in FIGS. 5 and 6, the entry port to a reject slot is close to an entry port to a dispense slot such that the pitch of the entry ports is not regular. By locating the entry port to a reject slot close to the entry port to a dispense slot, it is only necessary to rotate the wheel through a small angle such that media can enter a reject slot instead of a dispense slot. In order that the direction of rotation of the wheel is constant, the reject slot may be positioned with an entry port which is both close to the entry port of a dispense slot and such that in operation it aligns with the exit portion 407 of the media path 401 after the dispense slot.

In FIGS. 5 and 6 the diverting stacker wheel is shown having 4 tines which define 4 slots, with two slots being dispense slots and two slots being reject slots and where the dispense and reject slots are interleaved. This arrangement of tines and slots is shown by way of example only and other examples may have different arrangements of tines and slots, for example, only one reject slot with multiple dispense slots (e.g. 3 or 4 short slots) and/or larger numbers of tines and reject/dispense slots. The ratio of reject and dispense slots may be selected according to the regularity with which problems with picked media are expected.

FIG. 7 shows a second example of a diverting stacker wheel 700 for use in a media dispenser, for example as part of an automated teller machine (ATM). The diverting stacker wheel comprises a web-like hub consisting of spokes 701 attached to the axle. There are 6 tines attached to the hub which define 6 slots: 5 shorter dispense slots 702 and one longer reject slot 703. Of the 6 tines, 4 tines 704-707 are substantially identical whilst 2 tines 708, 709 are different because these 2 tines each have a surface 708*a*, 709*a* which defines the reject slot 703 and a surface 708*b*, 709*b* which defines a dispense slot 702. As in FIG. 5, the reject slot is both longer than a dispense slot but also ends closer to the axle of the stacker wheel. In the example of FIG. 7, the width of each slot and the opening of each slot are substantially identical and the pitch of the entry ports to the slots is regular (e.g. substantially equally spaced around the circumference of the wheel). In the example shown in FIG. 7, the tip of each tine is angled such that the angled face 710 traces a circle as the diverting stacker wheel rotates. The end of the tip may be rounded, rather than a sharp point. This is for ease of manufacture and to minimize damage to media should it be inadvertently struck by the tip of a tine. In another embodiment, the tip of a tine may be straight rather than angled (e.g. the tip may be formed perpendicular to one of the surfaces 708*a*, 708*b*, 709*a*, 709*b* of the tine) or may be more pointed in shape (as shown in FIG. 5).

Whilst the example stacker wheels shown in FIGS. 5 and 7 show two different arrangements of tines and slots, many other arrangements and variations may be used. For example, the reject and the dispense slots may have the same length but the angle of entry may be different (e.g. a dispense slot may have a shallower angle than a reject slot) such that media held in a reject slot is held closer to the centre of the wheel than media held in a dispense slot (e.g. in a corresponding manner to that shown in FIG. 6).

Each tine of a diverting stacker wheel (as shown in FIGS. 5 and 7) may have a substantially uniform width, w, as shown in FIG. 8, which shows a side view of a diverting stacker wheel 800, (e.g. the width, w=7.0 mm), where the width of a tine is defined in a different manner to the width of a slot (discussed above). The width of a tine is measured in a direction parallel to the axis of rotation 802 of the stacker wheel. A width of 7.0 mm is considered an optimum width because the wide surfaces of the tine reduce the risk of damaging the media by contact with narrow edges and/or surfaces, whilst also providing a structure which is robust and can be easily manufactured, (as w increases, it becomes harder to remove the structure from a mould).

Although, as described above, the tines may have substantially uniform width, w, the sides of the tines may be provided with grooves. Such grooves may be provided in the thicker parts of the tines. Grooves may, in addition or alternatively, be provided in other parts of the stacker wheel such as the spokes and the axle. These grooves are beneficial as they reduce the cross-section of the material which makes the wheel easier to manufacture by molding.

The axle of a diverting stacker wheel may be substantially cylindrical in shape, as shown in FIG. 8. In this example, the axle comprises a first portion 801*a* extending parallel to the axis of rotation 802 from one side of the stacker wheel, and a second portion 801*b* extending parallel to the axis of rotation 802 from the opposite side of the stacker wheel. The first portion 801*a* of the axle has an inner diameter d1 (not shown in FIG. 8) and an outer diameter d2 (see FIG. 8), whilst the second portion 801*b* has an inner diameter d3 (not shown in FIG. 8) and an outer diameter d4 (see FIG. 8).

The stacker wheel may be arranged such that a plurality of identical stacker wheels can be connected together in a modular manner with a common axis of rotation. In this example the stacker wheels are connected together by inserting the second portion 801*b* of a first stacker wheel into the first portion 801*a* of a second stacker wheel and therefore this requires the outer diameter of the second portion, d4 to be smaller than or equal or the inner diameter of the first portion, d1. Once the second portion 801*b* of a first stacker wheel has been inserted into the first portion 801*a* of a second stacker wheel, the two may be aligned and connected together by means of co-operating lugs 803 and holes 804. The first portion 801*a* may include one or more set of holes such that stacker wheels may be connected together with different spacing. In another example, a stacker wheel could be provided with more than two lugs mounted on resilient members, and a corresponding increase in numbers of holes, e.g. three lugs on the second portion of the axle 801*b* and then corresponding numbers of holes on the first portion 801*a* depending on the numbers of different connection positions. As the connecting lugs 803 are mounted on resilient members, it may be possible to separate the stacker wheels once connected and reconnect them as required. This has benefits should one or more wheels of a stacker wheel assembly require replacement. Whilst the one or more sets of holes may be arranged such that the stacker wheels may be connected together with different rotational alignment, this may only be appropriate where there is a degree of rotational symmetry within the wheel.

As described above the lugs 803 and holes 804 may provide a dual function as they both serve to align two stacker wheels and to connect them together. Lugs and holes are only one example of an aligning and connecting mechanism that can be used. In another embodiment, the inside of the first portion 801*a* of the axle could be provided with a series of grooves and ridges running parallel to the axis of rotation. The outside of the second portion 801*b* of the axle could be provided with a corresponding series of grooves and ridges such that the ridges on the second portion 801*b* fit into the grooves inside a first portion 801*a* of a second stacker wheel. If the fit between parts 801*a* and 801*b* is sufficiently tight, the ridges and grooves could provide both alignment and connection functions or alternatively a separate connection mechanism could be provided.

As described above, in an alternative embodiment separate features could be used for aligning stacker wheels and connecting the stacker wheels together. For example the external cross-section of the second portion could be non-circular (e.g. hexagonal, elliptical etc) and the internal cross-section of the first portion could be the same non-circular shape. Therefore the second portion of a first stacker wheel could still fit within a first portion of a second stacker wheel in such a manner that they are aligned. A separate connection mechanism (e.g. hole and locking pin) could be provided.

In operation, the diverting stacker wheel rotates in a clockwise direction (in the orientation shown in FIG. 4). Media is fed along the media path 401 and if no problem is detected with the media (e.g. at the MTS or any other sensing mechanism), the media is fed into one of the dispense slots (e.g. slot 503 and position 601 as shown in FIGS. 5 and 6). As the wheel rotates, the media located in these dispense slots is removed from the wheel by the first stripper fingers 403 and deposited in a stack position on a dispense belt 404. Media to be rejected (e.g. as a result of a multiple pick detection by the MTS) is not fed into one of the dispense slots but is instead fed into one of the reject slots (e.g. slot 504 into position 602 as shown in FIGS. 5 and 6). The rejected media in this position passes the first stripper fingers as the first stripper fingers do not extend far enough towards the centre of the stacker wheel to reach the rejected media. Instead, the rejected media is removed from the wheel by the second stripper fingers 404 and deposited into a rejected media path 406. Media may be propelled along the rejected media path 406 using a driven belt system as used elsewhere in the dispenser. In order to remove the media from the longer slots, the second stripper fingers extend much closer to the centre of the stripper wheel than the first stripper fingers as shown in FIG. 4. The media may then be pinched between a pair of moving belts and carried away to a purge bin. In another example, a single set of stripper fingers may be used which are moveable between a first position and a second position, wherein in the first position the stripper fingers extend a first distance towards the centre of the stacker wheel and in the second position the stripper fingers extend much closer to the centre of the stacker wheel.

In order to correctly feed media into the required slot (e.g. rejected media into a reject slot, other media into a dispense slot), the position of the wheel compared to the media path 401 is controlled. In a first example, the diverting stacker wheel may be rotated at a substantially constant speed such that as each note arrives at the stacker wheel, the exit portion 407 of the media path is aligned with a dispense slot. For example, if a note arrives at the stacker wheel approximately every 200 ms, the stacker wheel may be rotated at a speed of 2.5 or 3 revolutions/second (e.g. for the diverting stacker wheel 500, shown in FIG. 5). If a problem is detected with the note, the entry of the note into the stacker wheel may be delayed slightly such that it enters a reject slot. For example, the speed of the belts in the media path 401 may be reduced such that as the problematic note arrives at the stacker wheel, the exit portion 407 is aligned with a reject slot instead of a dispense slot. In another example, the note may be accelerated in the media path such that as the problematic note arrives at the stacker wheel, the exit portion 407 is aligned with a reject slot instead of a dispense slot. It will be appreciated that the rotational speeds given herein are provided by way of example only and any suitable speed may be used to match the arrival of notes at the wheel with the correct slot type.

Instead of rotating the diverting stacker wheel at a constant speed and controlling the arrival of the media at the stacker wheel, the media may move at a substantially constant speed in the media path and the stacker wheel motion may be changed in order that the correct type of slot (dispense/reject) is aligned with the exit 407 of the media path at the point that each note arrives at the stacker wheel. In an example, the stacker wheel may be normally rotated at constant speed (e.g. 150-180 rpm as described above) however when a problem is detected with the media, the speed of rotation may be altered, for example by stepping the wheel through a defined angle, by reducing/increasing the speed of rotation of the wheel or by otherwise adjusting the motion of the wheel in order that the media may be fed into a reject slot. By having entry ports close together (as described above) the angle through which it is necessary to step the wheel upon detection of problematic media is reduced.

The diverting stacker wheel 402, 500, 700, 800 as shown in FIGS. 4-8 may be integrally formed from a plastic material by molding or other suitable manufacturing process. The diverting stacker wheel could alternatively be cast in metal or formed from any other suitable material. The integral formation of the tines, lugs and holes, results in the alignment of tines of each stacker wheel in a stacker wheel assembly being guaranteed. Furthermore, the integral molding of the axle minimizes the numbers of piece parts, makes assembly of a stacker wheel assembly both simple and quick and eliminates problems such as wear and differential thermal expansion which can be caused by material mismatch.

Any range or device value given herein may be extended or altered without losing the effect sought, as will be apparent to the skilled person. Any features from any example shown in the figures or described above may be combined in any way with other features shown or described in the same or other examples.

The steps of the methods described herein may be carried out in any suitable order, or simultaneously where appropriate.

It will be understood that the benefits and advantages described above may relate to one embodiment or may relate to several embodiments. It will further be understood that reference to 'an' item refer to one or more of those items.

It will be understood that the above description of a preferred embodiment is given by way of example only and that various modifications may be made by those skilled in the art. The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the spirit or scope of this invention.

What is claimed is:

1. A stacker wheel having an axis of rotation central to said stacker wheel, said stacker wheel comprising:

a plurality of tines attached to a central hub, said plurality of curved tines defining a plurality of slots therebetween, and each said slot having an end proximal to said central hub;

wherein said plurality of slots comprises at least one of a first type of slot and at least one of a second type of slot, said first type of slot having said end positioned closer to said axis of rotation than said end of said second type of slot;

wherein said plurality of slots comprises an equal number of said first type of slot and said second type of slot; and wherein said slots of said first type and said second type are interleaved.

2. A stacker wheel having an axis of rotation central to said stacker wheel, said stacker wheel comprising:

a plurality of tines attached to a central hub, said plurality of curved tines defining a plurality of slots therebetween, and each said slot having an end proximal to said central hub;

wherein said plurality of slots comprises at least one of a first type of slot and at least one of a second type of slot, said first type of slot having said end positioned closer to said axis of rotation than said end of said second type of slot; and wherein said first type of slot is wider than said second type of slot.

3. A media dispenser including a stacker wheel having an axis of rotation central to said stacker wheel, said stacker wheel comprising:

a plurality of tines attached to a central hub, said plurality of curved tines defining a plurality of slots therebetween, and each said slot having an end proximal to said central hub; and wherein said plurality of slots comprises at least one of a first type of slot and at least one of a second type of slot, said first type of slot having said end positioned closer to said axis of rotation than said end of said second type of slot;

a first set of fingers arranged to remove media from said first type of slot;

a second set of fingers arranged to remove media from said second type of slot; and wherein said first set of fingers are further arranged to dispatch media removed from said first type of slot to a purge bin; and said second set of fingers are further arranged to dispatch media removed said second type of slot to a dispenser slot.

4. An automated teller machine including a stacker wheel having an axis of rotation central to said stacker wheel, said stacker wheel comprising:

a plurality of tines attached to a central hub, said plurality of curved tines defining a plurality of slots therebetween, and each said slot having an end proximal to said central hub; and wherein said plurality of slots comprises at least one of a first type of slot and at least one of a second type of slot, said first type of slot having said end positioned closer to said axis of rotation than said end of said second type of slot.

5. An automated teller machine according to claim 4 further comprising:

a first set of fingers arranged to remove media from said first type of slot; and a second set of fingers arranged to remove media from said second type of slot.

6. An automated teller machine according to claim 5, wherein:

said first set of fingers are further arranged to dispatch media removed from said first type of slot to a purge bin; and said second set of fingers are further arranged to dispatch media removed said second type of slot to a dispenser slot.

* * * * *